United States Patent [19]

Sandhaus

[11] 4,442,945

[45] Apr. 17, 1984

[54] UNITARY SCREW-TYPE SAFETY CLOSURE AND CLOSURE-CONTAINER COMBINATION

[76] Inventor: Jeffrey Sandhaus, Rte. 9W, Snedens Landing, N.Y. 10956

[21] Appl. No.: 399,237

[22] Filed: Jul. 19, 1982

Related U.S. Application Data

[63] Continuation-in-part of Ser. No. 335,216, Dec. 28, 1981, Pat. No. 4,413,742.

[51] Int. Cl.[3] ..... B65D 55/02

[52] U.S. Cl. ..... 215/218; 215/216; 215/301; 215/330

[58] Field of Search ..... 215/216, 217, 218, 301, 215/330; 220/281

[56] References Cited

U.S. PATENT DOCUMENTS 4,154,354 5/1979 Ryder ..... 215/216

4,187,953 2/1980 Turner ..... 215/301

*Primary Examiner*—George T. Hall

*Attorney, Agent, or Firm*—Steinberg & Raskin

[57] ABSTRACT

A safety closure of the type having a unitary construction with a closed top from which an interiorly threaded skirt depends and a container having an exteriorly threaded neck on which the closure is mounted in sealing relationship. The safety closure has one or more locking members formed integrally therewith which are movable under the action of actuating apparatus between a non-locking position and a locking position in which the locking members engage appropriate corresponding locking elements provided on the neck of the container. The actuating apparatus is constituted by the top of the closure which has a dish-like configuration formed such that the application of a sufficient finger pressure on the top will result in the movement of the locking members from the locking to the non-locking position.

36 Claims, 31 Drawing Figures

92
94
96
96a
96b
98
100
102
102a
102b
103
104
106
108
110
12
114
116
27
28
30

UNITARY SCREW-TYPE SAFETY CLOSURE AND CLOSURE-CONTAINER COMBINATION

BACKGROUND OF THE INVENTION

This application is a continuation-in-part of application Ser. No. 335,216 filed Dec. 28, 1981, now U.S. Pat. No. 4,413,742.

The present invention relates generally to safety closures or safety caps and, more particularly, to safety closures of the type having a closed top from which an interiorly threaded peripheral skirt depends and which is mounted in sealing position on a threaded neck of a bottle by positioning the cap over the bottle neck and twisting or rotating the cap until the top closes the open bottle end.

It is of course desirable to provide for the closing of bottles or containers in a manner which will prevent access to dangerous or poisonous substances contained therein. For example, various types of pharmaceuticals including pills and liquids are packaged in bottles or containers which are stored on shelves in medicine cabinets or the like within easy reach of children. Moreover, many toxic household substances are packaged in bottles or cans which are stored within the easy reach of children. In order to prevent or at least discourage children from gaining access to such dangerous substances, safety closures or caps have been suggested which are intended to close a bottle or container in a manner so as to make it difficult for a child to remove the cap from the bottle, either intentionally or through inadvertence. Such known safety closures generally must be manipulated in a certain fashion in order to unlock the same from the bottle to permit its subsequent removal. For example, reference is made to the safety closures disclosed in U.S. Pat. No. 3,182,840 to Polzin, U.S. Pat. No. 3,514,003 to Fitzgerald, and U.S. Pat. No. 4,106,651 to Lemons.

However, none of the known safety closures are entirely satisfactory in use, and for this reason, many dangerous substances can still be found packaged in bottles or containers which are not provided with safety closures.

In general, a safety closure should have certain desirable features from both the standpoint of operation as well as from the standpoint of economy in manufacture. One important feature is that the opening of the bottle should be accomplished without any complicated or difficult maneuvers being required in order to permit ready access to the contents of the container for legitimate use. In this connection, it is important that the closure be readily removable not only by healthy adults but also by the elderly or infirm. Indeed, a significant problem restricting the wide adoption of presently available safety closures is the great degree of difficulty encountered by elderly or infirm individuals in performing the complicated and difficult manipulations required to remove such safety closures. On the other hand, however, the safety closure must be designed so as to present at least a minimum degree of difficulty to its being unlocked and removed in order to prevent young children from obtaining access to the contents. In this respect, it is especially desirable for the safety closure to be designed in a manner such that the degree of difficulty in removing the same from the bottle can be adjustably varied during manufacture to suit specific requirements.

It is also desirable that an option be provided whereby the safety closure can be used in either a so-called safety or locking mode wherein unauthorized removal from the container is prevented and a non-locking mode wherein the cap can be removed from the container in the same manner as conventional so-called non-safety closures, i.e., by merely unscrewing the cap from the bottle. For example, it may be desired in households where there are no young children to permanently dispense with the necessity of manipulating the closure to unlock the same from the bottle every time access to the contents thereof is indicated.

Another desirable feature of a safety closure is that a visible or other easily discernable signal be provided which will readily indicate whether the closure is locked or lockable to the container or in an unlocked or unlockable condition wherein the closure can be removed from the container in the same manner as conventional non-safety closures without the need for an unlocking manipulation. Such a feature is especially beneficial where the closure is operated by an individual whose vision is impaired.

The safety closure should be readily adaptable for use with a wide range of container types and sizes thereby enabling closure of the great preponderance of packaging styles for both drugs as well as household substances.

In connection with the manufacture of the safety closure, it is desirable that the basic design thereof be relatively simple, namely a one-piece or unitary structure, which requires no special materials for its construction.

Finally, the closure member should meet all requirements for reliably preserving and storing pharmaceutical and household substances in both liquid and solid form and have a configuration which is both attractive and which facilitates being grasped by the user.

SUMMARY OF THE INVENTION

Accordingly, it is the main object of the present invention to provide new and improved safety closures having one or more of the desirable features enumerated above and which overcomes the disadvantages of the prior art closures.

More particularly, it is an object of the present invention to provide a new and improved safety closure for a container in which a dangerous substance is packaged which will reliably prevent unauthorized access to the container contents yet which does not require complicated or difficult manipulations to unlock the closure from the bottle.

Another object of the present invention is to provide a new and improved safety closure which can be used in either a so-called safety or locking mode or in a non-locking mode wherein the closure can be removed from the bottle in the same manner as a so-called non-safety closure, i.e., by merely untwisting the cap from the bottle.

Still another object of the present invention is to provide a new and improved safety closure wherein a visual, audible and/or palpable signal is provided which indicates that the closure has become locked or unlocked from the container and/or is in a locking or non-locking mode.

A further object of the present invention is to provide a new and improved safety closure having a design whereby the degree of difficulty encountered in removing the closure from the bottle can be adjustably varied during manufacture in order to suit specific requirements.

Yet another object of the present invention is to provide a new and improved safety closure having a unitary or one-piece construction which is economical in manufacture, capable of closing a wide variety of types of containers and bottles in which liquid or solid substances are contained and which is attractive in appearance.

Briefly, in accordance with the present invention, these and other objects are attained by providing an improved safety closure or cap of the type having a unitary or one-piece construction with a closed top from which an interiorly threaded skirt depends and which is mounted in sealing position on a threaded neck of a bottle by positioning the cap over the bottle neck and twisting or rotating the cap until its top closes the open bottle end. Conversely, the closure is removed by untwisting the cap over the bottle neck.

According to the invention, the safety closure is constructed of a substantially rigid but resilient material and with one or more locking means being formed integral therewith which are movable under the action of certain actuating means between a non-locking position and a locking position in which the locking means engage appropriate corresponding locking elements provided on the bottle neck. The actuating means are constituted by the top of the closure which has a normally convex dome-like shape and which is formed with the closure member in a particular manner such that the application of a sufficient finger pressure on the cap will result in movement of the locking means from the locking to the non-locking position. The cap is thus threaded onto the bottle by twisting until the cap is in sealing position at which time the locking means engage the locking element on the bottle neck to prevent the cap from being rotated in the opposite direction and thereby removed. However, when it is desired to reach the contents of the bottle, the top of the closure is depressed by applying a sufficiently large finger pressure thereto whereupon the locking means disengage from the locking elements allowing the cap to be untwisted from the bottle.

The threshold finger pressure on the closure top required to actuate the movement of the locking means can be selected through suitable design of the closure such, for example, as by slightly varying material thicknesses or the like. It is believed that a threshold actuation pressure of 8 pounds is satisfactory to preclude most young children from unlocking the closure except with the most concerted effort.

The present invention also comprises the combination of the safety closure and the container associated therewith.

Other advantages provided by the closure and combination of the invention, several embodiments of which are disclosed hereinbelow, will become apparent from the description which follows.

DESCRIPTION OF THE DRAWINGS

A more complete appreciation of the present invention and many of the attendant advantages thereof will be understood by reference to the following detailed description when considered in connection with the accompanying drawings in which.

DESCRIPTION OF THE PREFERRED EMBODIMENTS

Figure 2:
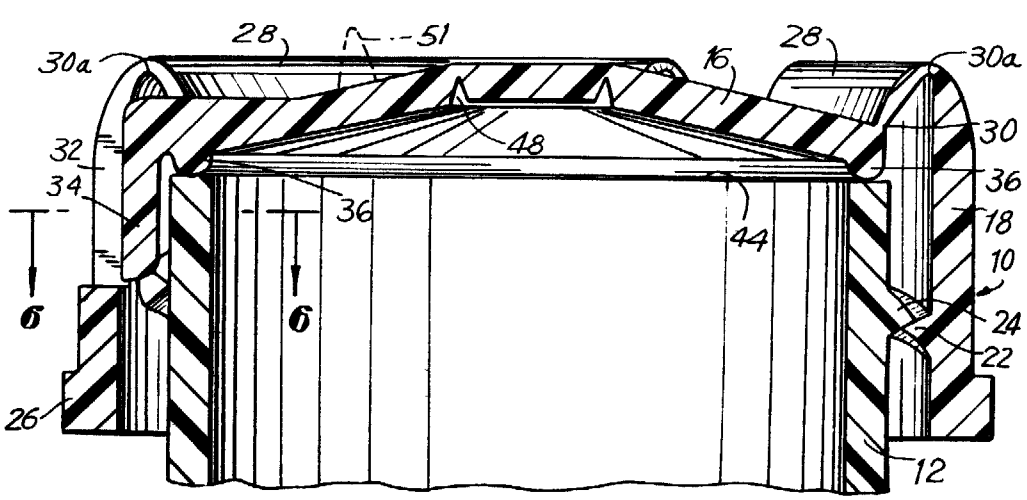
FIG. 2 is a section view taken along line 2—2 of FIG. 1.
Figure 1:
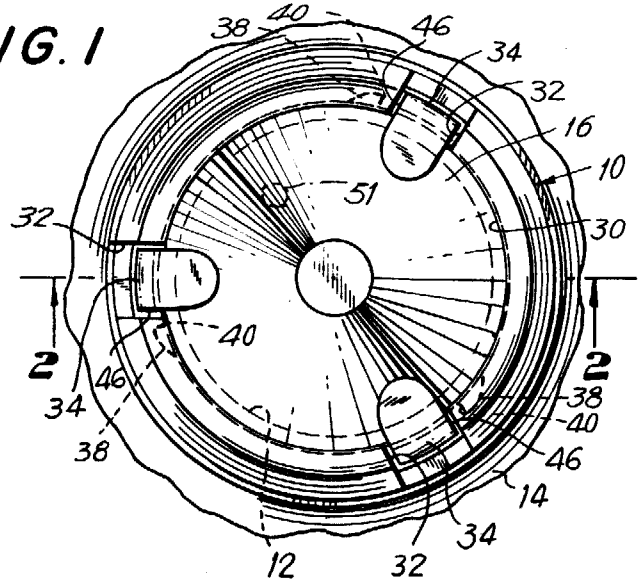
FIG. 1 is a top plan view of one embodiment of safety closure according to the present invention in sealing position on a bottle or container.
Figure 3:
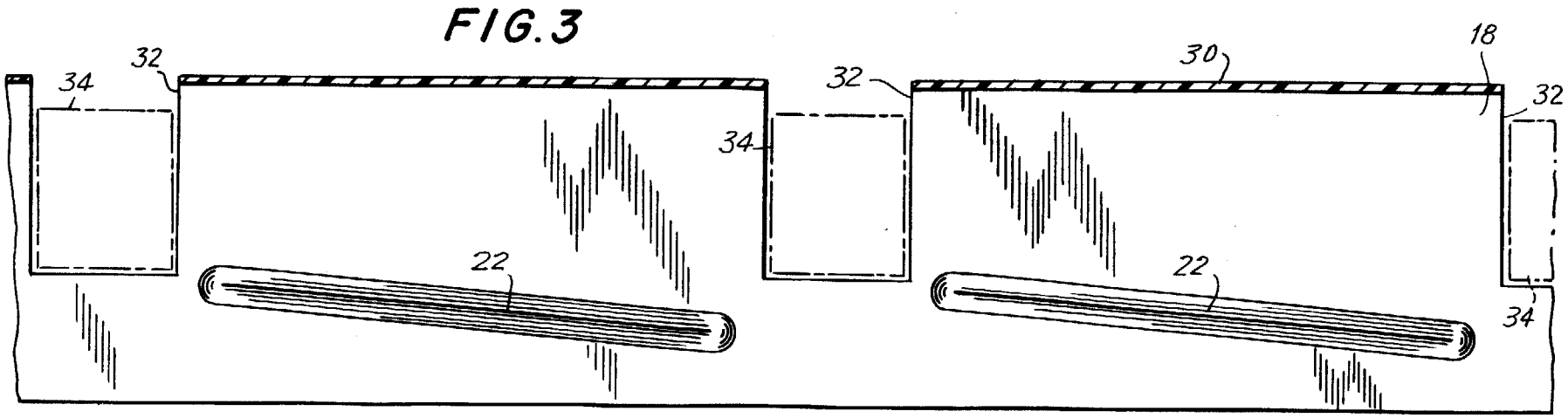
FIG. 3 is a development view illustrating the inner surface of the peripheral skirt of the closure embodiment of FIG. 1.

Referring now to the drawings wherein like reference characters designate identical or corresponding parts throughout the several views and in particular to the embodiment of the invention illustrated in FIGS. 1–8, a safety closure or cap, generally designated 10, is shown mounted on the neck 12 of a bottle or container 14. Referring in particular to FIGS. 1–3, the illustrated embodiment of the safety closure 10 has a unitary or one-piece construction including a closed top 16 from which a peripheral skirt 18 depends. The closure is formed of a substantially rigid but resilient material, such as plastic, preferably by conventional injection molding techniques. Threads are formed on the interior surface of skirt 18 adapted to mate with corresponding threads formed on the exterior surface of the bottle neck 12. Although in the illustrated embodiment the thread structure comprises three flights 22 (only two shown in FIG. 3) equally spaced from each other around the circumference of skirt 18 and three corresponding equally spaced flights 23 (only two shown in FIG. 4) on the bottle neck 12, it is understood that conventional helical thread structure may be utilized. The lower end of the skirt 18 is formed with a thickened rib portion 26 for purposes which will be made clearer hereinbelow.

The upper edge region of skirt 18 extends upwardly beyond the peripheral edge region of the top 16 and is integrally connected thereto by a web portion 28 which itself extends between junctions 30 and 30*a* which have a reduced thickness relative to that of the skirt and top.

A number of slots 32 are formed through the skirt 18, each of which extends downwardly from the web portion 28. In the illustrated embodiment, three such slots 32 are formed which are equally spaced from each other by 120° center-to-center intervals. A corresponding number of tab-like locking members 34 are integrally joined to the peripheral edge region of top 16, each of the locking members being aligned with and receivable within a respective one of the slots 32. Thus, in the illustrated embodiment, three locking members 34 spaced at 120° center-to-center intervals from each other are integral with and extend downwardly from the top 16 of cap 10. As best seen in FIG. 2 wherein the cap 10 is illustrated in its so-called locked mode such that removal from the bottle neck is prevented, the locking members extend downwardly from the top 16 and are displaced radially inwardly with respect to the skirt 18, the web portion 28 serving to space the skirt somewhat outwardly with respect to the peripheral edge region of top 16. A bead 36 is formed on the undersurface of top 16 to sealingly engage the upper edge of the bottle neck 12.

Figures 4, 5, 6, 7, 8:
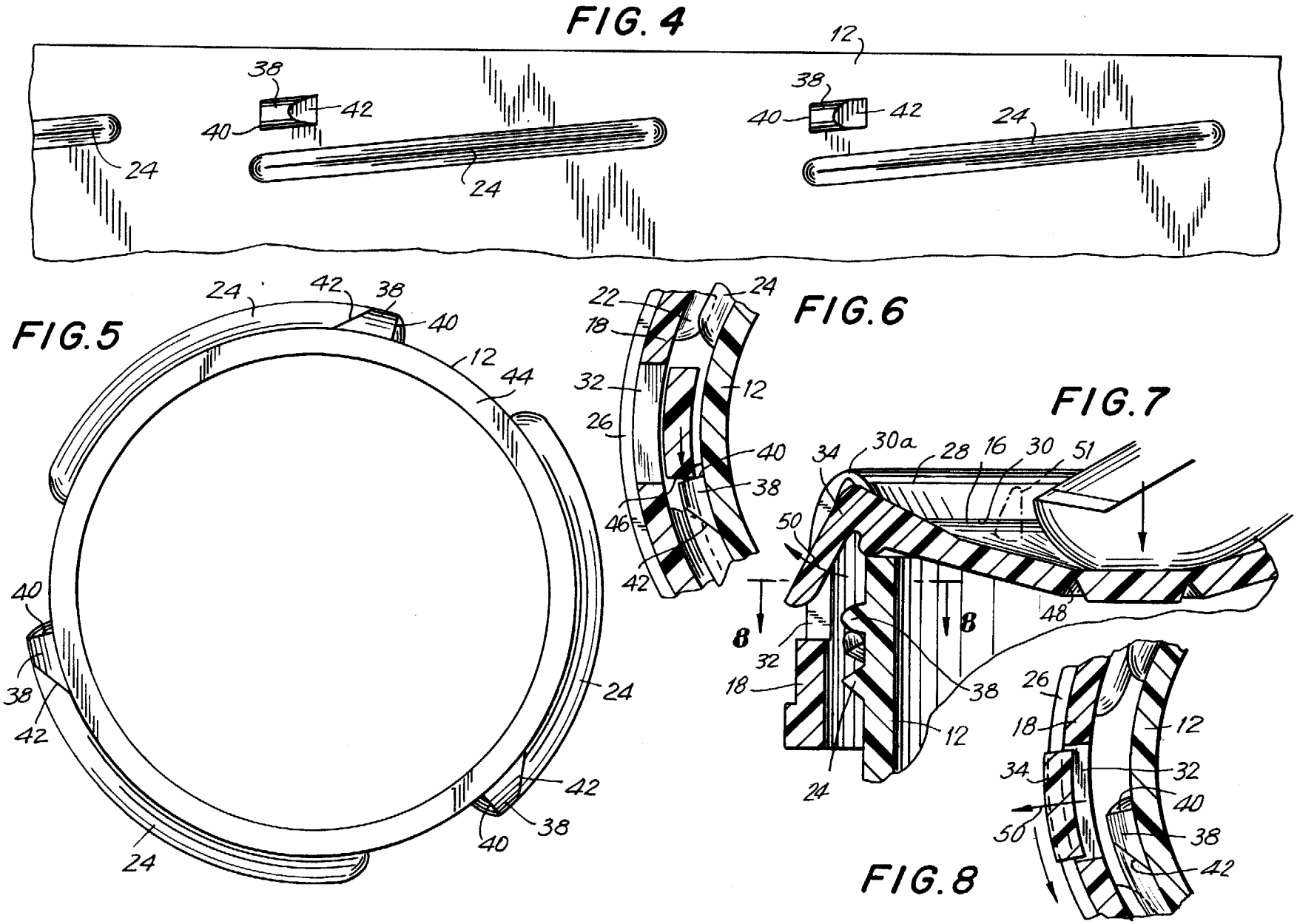
FIG. 4 is a development view illustrating the upper region of the outer surface of the bottle of FIG. 1.
FIG. 5 is a plan view of the bottle or container of FIG. 1.
FIG. 6 is a section view taken along line 6—6 of FIG. 2.
FIG. 7 is a fragmentary view similar to FIG. 2 and illustrating the unlocking of the closure from the bottle.
FIG. 8 is a section view taken along line 8—8 of FIG. 7.

Referring to FIGS. 4 and 5, the bottle neck 12 has a number of protuberances formed thereon situated over the threads 24 and preferably corresponding in number and spacing to the number and spacing of locking members 34. Each of the protuberances 38 presents a substantially radial abutment surface 40 facing the clockwise direction when viewed in FIG. 5, and an angled surface 42 facing the counterclockwise direction.

In mounting the cap 10 on the bottle neck 12, the cap is situated over the neck and twisted or rotated in a clockwise direction with the corresponding threads mating until the cap descends to a point where bead 36 comes into sealing engagement with the upper edge surface 44 of neck 12 as seen in FIG. 2. During rotation, the locking members 34 in their locking positions illustrated in FIGS. 2 and 6 engage the angled surfaces 42 of protuberances 38 and by virtue of the resilient nature of the material from which the cap is formed, flex outwardly to the extent necessary so that the locking members will ride over the protuberances. As seen in FIGS. 2 and 6, the cap and bottle are suitably configured such that when the cap reaches the position wherein the sealing bead 36 engages the surface 44 of the neck 12, the trailing edge 46 (relative to clockwise rotation of cap 10) of each locking member 34 is contiguous with an abutment surface 40 of a corresponding protuberance 38. It will be readily appreciated that should removal of the cap be attempted by rotating the cap in the counterclockwise direction, the edges 46 of the locking members will abut against and engage the abutment surfaces 40 so that counterclockwise rotation is obstructed. Thus, when the cap according to the invention is tightened over the bottle neck with the locking members in their locking position, it is not possible to untwist the cap by virtue of the construction described above.

According to the present invention, actuating means are provided for moving the locking members 34 from the locking positions illustrated in FIGS. 2 and 6 to non-locking positions illustrated in FIGS. 7 and 8, i.e., to positions wherein the edges 46 of locking members 34 are displaced outwardly from the abutment surfaces 40 of protuberances 38 to thereby permit a counterclockwise rotation and removal of the closure. More particularly, the top 16 of cap 10 has a substantially dish or dome-shaped configuration which when the locking members 34 are in their locking positions extends upwardly in the direction from the peripheral edge region of top 16 to a central region thereof. Thus, the top 16 has a normally convex dis-like construction as best seen in FIG. 2. A hinge groove 48 is formed in the lower surface of top 16 extending around a central portion thereof.

The construction of closure 10 is such that when a downward force greater than a certain minimum force is applied to the central region of top 16, such as by application of finger pressure, the latter will flex and "snap" into a concave or depressed configuration as seen in FIG. 7, the top flexing in the regions of the reduced thickness junctions 30 and 30*a* which act as hinges and the hinge groove 48. Moreover, the closure is preferably constructed as shown so that the top will remain in the depressed or concave configuration after being snapped into that position. Thus, the peripheral region of the top 16 will flex with respect to the hinge portions 30 and 30*a* while the central region of the top will flex about the hinge groove 48 with respect to the outer portion of top 16. The structural rigidity of the skirt which is provided by the hinge structure in addition to the reinforcing rib portion 26 acts to produce this over-center or "oil-can" type action of the top 16 which is advantageous for reasons made clear below.

Thus, when the central region of the top 16 in its convex configuration is depressed with a force greater than a certain minimum force, it will snap into the position shown in FIG. 7. At the same time the locking members 34 will flex in the direction of arrow 50 (FIGS. 7 and 8) through respective slots 32 whereby the edge 46 of each locking member will move to a disengaged or unlocking position out of alignment with the corresponding abutment surface 50 thereby permitting the cap to be unscrewed from the bottle neck. It should be understood that such flexure does not depend on any camming action between the bead 36 and any structure related to the neck 12.

When the finger pressure is released, the top will remain in its concave configuration so that the locking members 34 remain in their unlocking positions. This is advantageous in the case where it is desired to use the closure in the same manner as a conventional non-locking type closure, i.e., with the locking feature of the closure permanently disengaged. This may be desired in households where there are no young children. In such a case, the top 16 is always left in its depressed or concave configuration so that the locking members will never be obstructed by the protuberances 38 so that the cap can be merely screwed on and off the bottle as desired in a conventional manner. A lever 51, shown in phantom in FIGS. 1, 2 and 7, may extend from the top 16 which may be manipulated by the user when it is desired to return the cap to its locking mode, i.e., to snap the top back to its convex configuration.

It should also be apparent that the minimum pressure to be applied to the top 16 of cap 10 can be suitably selected during manufacture by appropriate design modifications such, for example, as increasing or decreasing the thickness of the top or the junction 30. The minimum force to actuate movement of the locking member 34 should be at least 8 pounds and preferably in the range of about 10 to 12 pounds which is small enough that elderly or infirm people will have little difficulty in operating the same but which is sufficiently large so that small children will not be able to accomplish an unlocking of the cap.

Another advantage provided by the structure of the invention is that visual, audible and palpable signals are simultaneously provided when the top of the cap is depressed from its locking to its non-locking position. Thus, the fact that the cap is in its non-locking mode is clearly visually apparent from the concave configuration of the top. Similarly, this configuration is readily apparent by touch which is advantageous for individuals whose vision is impaired. Moreover, when the top snaps from the locked to the unlocked position an audible noise is generated indicative of the condition of the closure.

Referring now to FIGS. 9–14, another embodiment of a safety closure according to the present invention, generally designated 52, is illustrated. The same reference numerals are used in the description of this embodiment as were used to designate corresponding parts in the previously described embodiment.

The closure 52 has essentially the same construction as closure 10 differing therefrom in that means are provided whereby after the locking members 34 are moved to their unlocking position in connection with the removal of cap 10 from the bottle neck 12, the locking members 34 will be automatically returned to their locking positions as the cap is untwisted from the bottle. Accordingly, it is not necessary for the user to remember to "snap" the dish-shaped top back from its concave non-locking configuration into its locking configuration every time the cap is removed from the bottle.

Figures 9, 10, 11, 12, 13, 14:
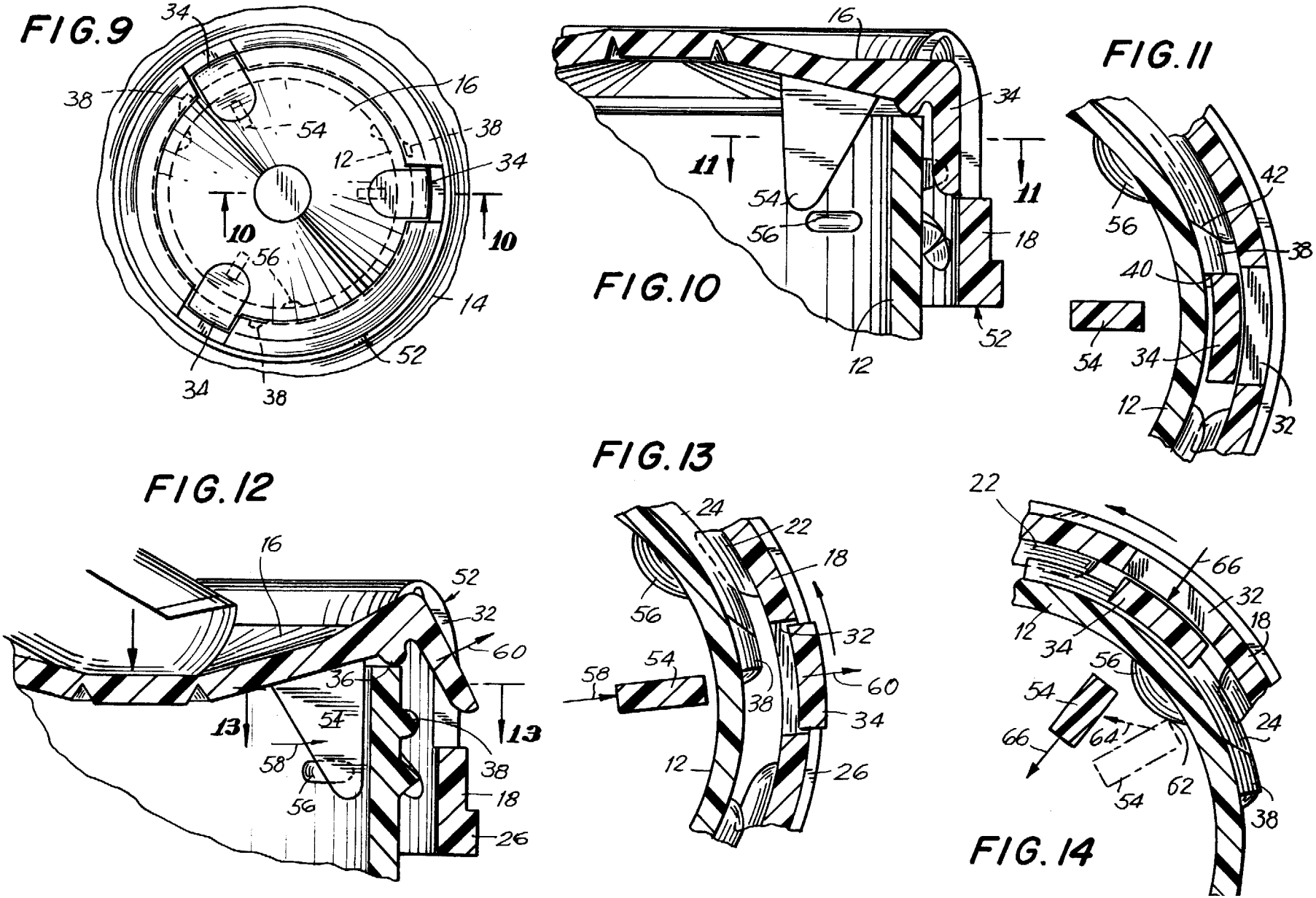
FIG. 9 is a plan view similar to FIG. 1 and illustrating a second embodiment of a closure and closure-bottle combination according to the present invention wherein provision is made for returning the closure to its locking mode during the untwisting rotation of the cap.
FIG. 10 is a section view taken along line 10—10 of FIG. 9.
FIG. 11 is a section view taken along line 11—11 of FIG. 10.
FIG. 12 is a view similar to FIG. 7 illustrating the unlocking of the closure illustrated in FIG. 9.
FIG. 13 is a section view taken along line 13—13 of FIG. 12.
FIG. 14 is a view similar to FIG. 13 illustrating the return of the closure to its locking mode during the untwisting operation.

To this end a finger 54 extends downwardly from the undersurface of top 16 of cap 10 such that it extends within the neck 12 of the bottle when the cap is mounted thereon. Moreover, a protuberance 56 is formed on the inner surface of neck 12 extending radially inwardly a limited distance. As seen in FIGS. 9–11, when the cap is in its locked mode, i.e., with the top 16 in its convex configuration, the finger 54 extends away from the inner surface of the neck 12 in the downward direction so as to be spaced a sufficient distance therefrom such that the finger 54 will not engage the protuberance 56 as the cap is rotated as seen in FIGS. 9–11. Thus, as seen in FIGS. 9–11, when the cap 10 is in its locked mode with the locking members 34 in their locking positions, a clockwise or tightening rotation thereof will mount the cap on the bottle in the same manner as described above in connection with FIGS. 1–8. The finger 54 will not engage the protuberance 56 during such tightening rotation. FIG. 11 depicts the cap-bottle combination with the cap 10 sealingly locked to the bottle neck 12.

When access to the contents of the container is desired, the top 16 is depressed through the application of at least the minimum force required as seen in FIG. 12 so that the top 16 "oil-cans" to the position illustrated. At the same time, the finger 54 which is attached to the lower surface of top 16 moves to the position illustrated in FIGS. 12 and 13 as indicated by arrow 58 as the locking members 34 flex to their non-locking positions designated by arrows 60. It is therefore seen that with the locking members 34 in their unlocked position, the finger 58 has moved closer to the inner surface of the bottle neck 12. Thus, a subsequent counterclockwise untightening rotation of the cap, which is permitted by virtue of the locking members 34 having been moved out of alignment with the abutment surface 40 of protuberance 38, will result in the finger 54 engaging the protuberance 56 at the point designated 62 (FIG. 14). The protuberance 56 is so shaped that continued rotation of the cap results in a camming action urging the finger 54 in an inward direction as designated by arrow 64 causing the top 16 to flex towards its locked or convex configuration. When the top flexes to a sufficient degree, it will snap to its locked configuration causing the locking members 34 to move into their locked positions as designated by arrows 66 in FIG. 14.

It is therefore seen that the embodiment of the safety closure illustrated in FIGS. 9–14 has a feature whereby the cap will return to its locked mode from its unlocked condition in an automatic fashion as it is untightened from the bottle neck. Thus, the cap is in condition for being remounted on the bottle neck in its locking configuration as soon as it is removed from the bottle.

Figures 15, 16, 17, 18, 19, 20, 21, 22, 23, 24, 25:
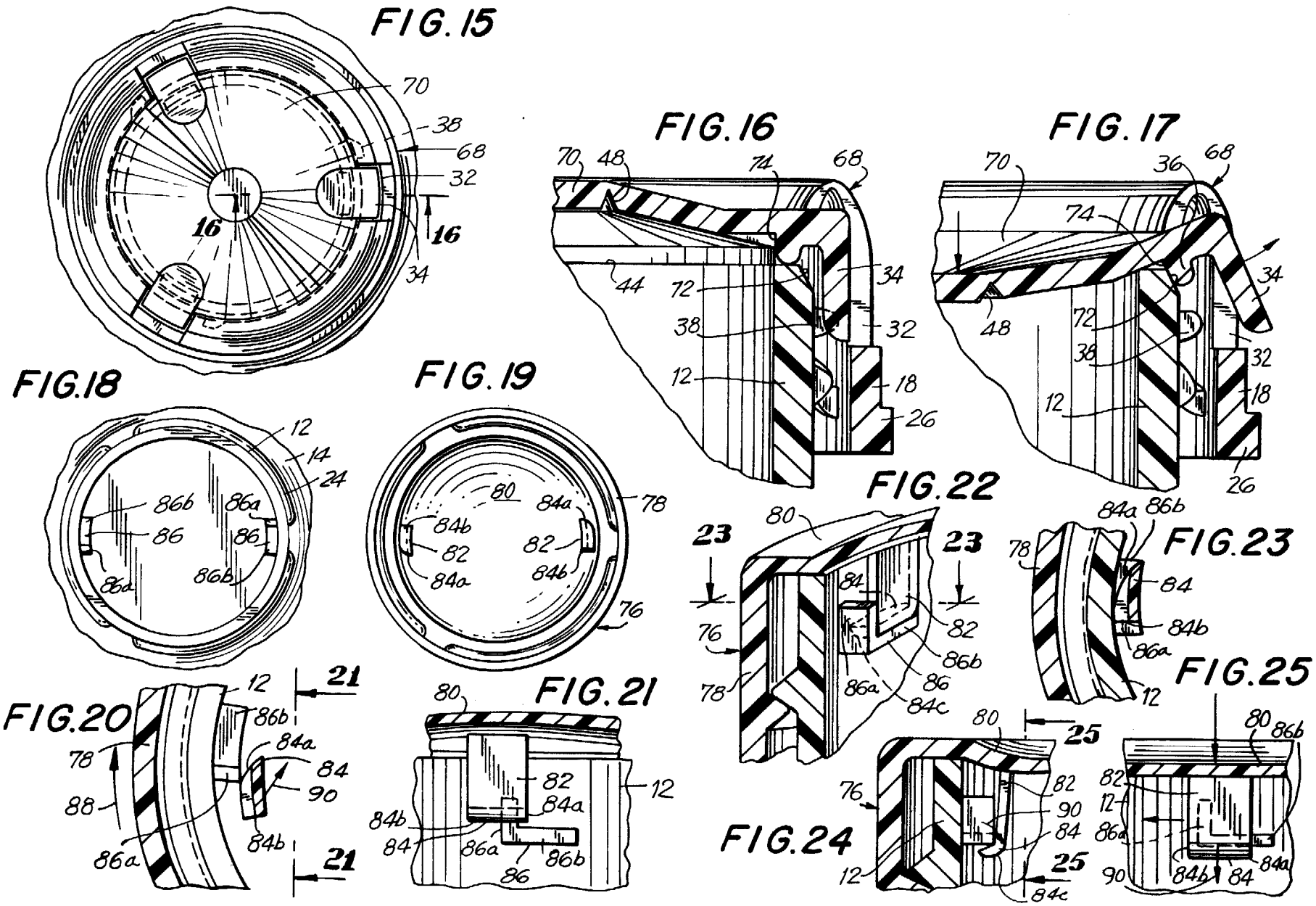
FIG. 15 is a plan view of a third embodiment of a closure and closure-bottle combination according to the present invention.
FIG. 16 is a section view taken along line 16—16 of FIG. 15.
FIG. 17 is a view similar to FIG. 16 and illustrating the unlocking operation of the closure.
FIG. 18 is a plan view of the neck of a bottle forming a part of a closure-bottle combination according to yet another embodiment of the present invention.
FIG. 19 is a bottom plan view of a closure forming a part of the embodiment of the closure-bottle combination of FIG. 18.
FIG. 20 is a fragmentary view illustrating the locking operation of the embodiment of the invention illustrated in FIGS. 18 and 19.
FIG. 21 is a view taken in the direction of line 21—21 of FIG. 20.
FIG. 22 is a fragmentary perspective view of the embodiment of the invention illustrated in FIGS. 18–21 with the closure being locked to the bottle.
FIG. 23 is a section view taken along line 23—23 of FIG. 22.
FIG. 24 is a fragmentary view of the embodiment illustrated in FIGS. 18–23 during the unlocking of the closure from the bottle.
FIG. 25 is a view taken in the direction of line 25—25 of FIG. 24.

Another embodiment of a closure according to the present invention which provides an automatic return of the locking members to their locked positions as the cap is rotated to untighten the same from the bottle neck is illustrated in FIGS. 15–17. Again, the same reference numerals are used in the description of this embodiment as were used to designate corresponding parts in the embodiment illustrated in FIGS. 1–8.

The safety closure, designated 68, has essentially the same structure as cap 10 except as follows. The top 70 has a modified form relative to the top 16 such that when depressed to the concave or unlocked configuration illustrated in FIG. 17 and the finger pressure removed therefrom, the top 70 will normally spring back to its convex locked configuration illustrated in FIG.

16. In other words, unlike the top 16 of the previously described embodiments, the top 70 is formed such that when the finger pressure is removed after flexing the top 70 to its unlocked configuration, the top will normally return unless otherwise restrained in the position illustrated in FIG. 16. Such return action is achieved by reducing the depth of the hinge groove 48, for example.

According to this embodiment, the outer region of the upper edge surface 44 of bottle neck 12 is beveled as at 72 and the bead 36 is formed with an inwardly facing planar surface 74.

In operation, with the cap 68 in its tightened condition wherein it is locked to the bottle neck 12 as seen in FIG. 16, the top 70 is depressed by a finger force in excess of the minimum required force whereupon the locking members 34 move from their locked position to their unlocking position illustrated in FIG. 17. At the same time, the bead 36 moves radially outwardly on the upper edge surface 44 of bottle neck 12 until the axial surface 74 of the bead engages the beveled edge surface 72 of the bottle neck. The engagement of the bead surface 74 and beveled edge surface 72 acts to restrain the top 70 from returning to the unflexed locked configuration of FIG. 16. Thus, the user can remove pressure from the top 70 and with the locking members 34 being held in their non-locking positions untwist the cap. However, when the cap has been unscrewed to an extent whereby the axial surface of bead 74 becomes disengaged from the beveled edge surface 72, all restraints tending to hold the top in its depressed condition are removed whereupon the top will automatically return to its locking configuration illustrated in FIG. 16. Thus, it is recognized that in this embodiment as well as the embodiment illustrated in FIGS. 9–14, the user can release the pressure on the top of the cap after depressing the same since the cap will remain in its unlocked configuration whereupon the cap can be untwisted and that during such untwisting, the cap will automatically return to its locking configuration.

Referring now to the embodiment of the invention illustrated in FIGS. 18–25, a safety closure, generally designated 76, comprising yet another embodiment of the present invention is illustrated. The closure 76 is similar to the embodiments described hereinabove in that locking means are formed integrally with the safety closure which are movable between non-locking and locking positions in the latter of which the locking means engage appropriate corresponding locking elements provided on the bottle neck and wherein actuating means are provided for moving the locking means which comprise a normally convex dome or dish-shape top of the closure. However, the closure 76 differs from the previously described embodiments in that the locking means are integrally formed with the closure cap in a manner so as to extend within the interior space defined by the bottle neck and cooperate with locking elements formed on the inwardly facing surface of the bottle neck.

More particularly, the closure 76 includes a peripherally extending interiorly threaded skirt 78 and an integral top 80 having a dome or dish-shaped configuration as seen in FIGS. 21 and 22. A pair of locking members 82 extend downwardly from the dome-shaped portion of top 80 terminating at their lower ends with outwardly extending portions 84 which will be located substantially contiguous with the inner surface of the bottle neck 12 when the cap is being tightened thereon. The leading edge **84*a* in the clockwise or twisting direction is curved as seen in FIGS. 19, 20 and 23 while the trailing edge 84*b* is substantially radial. It is noted that one or more such locking members 82** may be provided, two being shown in the illustrated embodiment.

A corresponding number of inwardly extending substantially LOshaped locking elements 86 are provided on the inner surface of bottle neck 12. Thus, each locking element 86 includes an axially extending portion **86*a* and a circumferentially extending portion 86*b***.

The function of the elements described above will be readily understood from a description of the operation of this embodiment of the safety closure. In order to tighten the closure 76 on the bottle neck 12, the closure is situated over the bottle neck and rotated in the clockwise direction as indicated by arrow 88 in FIG. 20. Eventually, the curved leading edges **84*a* of the catch portions 84 engage the axially extending portions 86*a* of the locking elements 86. However, further rotation in this direction is possible by virtue of the fact that the catch portions 84 will be cammed inwardly as designated by arrow 90 in FIG. 20 so that the cap can be fully tightened over the bottle neck. When the cap reaches its tightened position on the bottle neck, the catch portions 84 of locking members 82 have snapped into the position illustrated in FIGS. 22 and 23 relative to the locking elements 86. It will be seen that a counterclockwise or untwisting rotation of the cap 76 will be prevented by virtue of the abutment of the trailing edge 84*b* of the catch portions 84 with the axially extending portion 86*a* of the locking elements 86**.

When it is desired to gain access to the bottle, the dome-shaped top 80 of the cap 76 is depressed as seen in FIG. 24. When this occurs the lower surface **84*c* which is curved as seen in FIG. 22 cams outwardly and downwardly in the direction designated by arrow 90 in FIGS. 24 and 25 wherein the axially extending portions 86*a* of locking elements 86 no longer present an obstacle to the counterclockwise untwisting rotation of cap 76. Thus, the cap 76 can then be removed from the bottle neck 12. When the cap is unscrewed from the bottle neck, the dome-shaped top 80** will resume its original shape in preparation for being mounted again on the bottle neck.

Another embodiment of a safety closure, designated 92, according to the present invention is illustrated in FIGS. 26–30. This embodiment of the closure is similar to the embodiments described above in that it comprises a normally dish or dome-shape top 94 which constitutes actuating means for moving locking means integrally formed as part of the closure between a non-locking position and a locking position in which the locking means engage locking elements provided on the bottle neck.

Figures 26, 27, 28, 29, 30, 31:
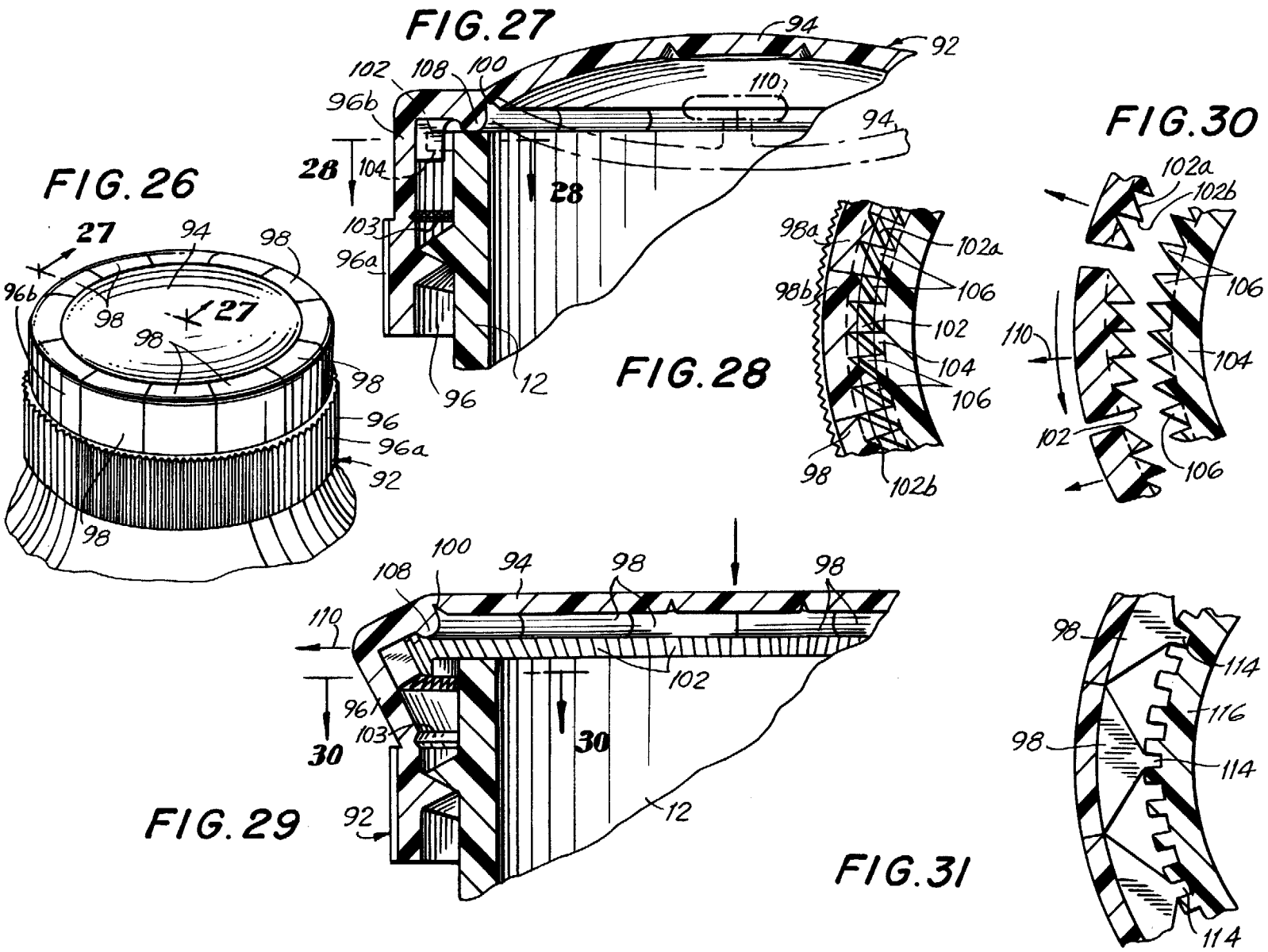
FIG. 26 is a perspective view of still another embodiment of a closure and closure-bottle combination in accordance with the present invention.
FIG. 27 is a section view taken along line 27—27 of FIG. 26.
FIG. 28 is a section view taken along line 28—28 of FIG. 27.
FIG. 29 is a view similar to FIG. 27 and illustrating the closure in its unlocked position on the bottle neck.
FIG. 30 is a section view taken along line 30—30 of FIG. 29.
FIG. 31 is a view similar to FIG. 28 illustrating a modification of the embodiment of the invention illustrated in FIGS. 26–30.

More particularly, the closure 92 includes a peripherally extending skirt 96 having a lower circumferentially extending fluted portion **96*a* and an upper portion 96*b* formed by a plurality of locking segments 98. Each of the locking segments 98 is integrally joined with the top 94 at an upper groove hinge 100 and to the lower fluted portion 96*a* of the skirt by a second groove hinge 103. However, adjacent locking segments 98 are separated from each other as seen in the figures. Thus, as seen in FIG. 28, locking segments 98*a*, 98*b* and 98*c* have respective adjoining side surfaces. Moreover, a plurality of inwardly extending teeth 102 are formed on the inwardly facing surface of each locking segment 98. The teeth 102 preferably have a saw-tooth configuration as best seen in FIGS. 28 and 30, each tooth having an angled leading edge 102a in the clockwise direction and a substantially radial trailing edge 102b. The upper end of the bottle neck 12 is provided with a toothed rim 104 having a plurality of correspondingly shaped teeth 106** extending outwardly therefrom.

In operation, the closure 92 is applied to the bottle neck with the top 94 in its locking position as illustrated in solid lines in FIG. 27. In this configuration, the locking segments 98 are in their respective locking positions as illustrated in FIG. 27. The cap is rotated in a clockwise direction until it is tightened on the bottle neck with the bead 108 engaging the upper edge surface of the bottle neck. During such clockwise rotation, the teeth 102 of the locking segments 98 engage the teeth 106 of the toothed rim 104. However, continued rotation is possible due to a camming action between engaging surfaces of the respective teeth by virtue of the saw-tooth construction described above. However, when the cap is fully tightened over the bottle neck, a counterclockwise untightening rotation is prevented by virtue of the abutment of the radial edges of the respective teeth 102 and 106.

When it is desired to unscrew the elosure 92 from the bottle neck, the top 94 is depressed with sufficient force to move the same to a horizontal position as shown in FIG. 29. This results in the peripheral edge regions of the dome-shaped top 94 being moved radially outwardly thereby causing the locking segments 98 to pivot about the first and second groove hinges 100 and 103 as best seen in FIG. 29. Consequently, the locking segments 98 are moved outwardly in the direction of arrow 110 (FIGS. 29 and 30) whereupon the teeth 102 and 106 are disengaged so that a counterclockwise untwisting rotation of the cap is possible. It is noted that unlike the embodiments previously described, the top 94 of closure 92 when in its non-locking position will extend substantially horizontally and not snap into a concave configuration.

One advantage of this embodiment is that the top 94 of closure 92 may be normally positioned with a concave configuration when in its so-called locking position as indicated in phantom in FIG. 27. In this connection, a handle 110 may be formed on the upper surface of the top 94 so that when it is desired to move the locking segments to their non-locking positions, it is only necessary to grasp the handle 110 and raise the top 94 to its horizontal position. This is advantageous in that the top cannot be inadvertently depressed, such as during shipping, by placing objects on top of the closure.

Referring to FIG. 31, a modification of the embodiment illustrated in FIGS. 26–30 is shown. In this modification, the locking segments are formed with inwardly extending locking fingers 114 which engage a gear tooth rim 116 provided at the upper end of the bottle neck. It is understood that in the case of such modification, the cap must be in its non-locking mode when screwed onto the bottle neck.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A safety closure having a unitary or one-piece construction comprising:

a closed top having a peripheral edge region;

an interiorly threaded skirt integral with and depending from the peripheral edge region of said top;

locking means formed integrally with said closure and movable under the action of actuating means from a locking position to a non-locking position; and actuating means for moving said locking means from the locking position to the non-locking position, said actuating means being constituted by said top of said closure which has a substantially dish-shaped locking configuration such that the application of a pressure on said top in excess of a certain minimum required pressure will deform said top into a non-locking configuration and result in movement of said locking means from the locking to the non-locking position.

2. The combination of claim 1 wherein said top is configured such that after the same is deformed from its locking configuration to its non-locking configuration, it will remain in its non-locking position.

3. The combination of claim 1 wherein said locking means are constituted by at least one tab-like locking member, each of which is integrally joined to the peripheral edge region of said top.

4. The combination of claim 3 wherein at least one slot is formed through said skirt, each of which extends downwardly from an upper region of said skirt, and wherein each of said tab-like locking members is aligned with and receivable within a respective one of said slots.

5. The combination of claim 4 wherein three locking members and three corresponding slots are spaced at about 120° intervals from each other.

6. The combination of claim 4 wherein said skirt has an upper edge region which extends upwardly beyond the peripheral edge region of the top and which is integrally connected thereto by a web portion at a junction having a reduced thickness relative to the thickness of the skirt and the top.

7. The combination of claim 6 wherein the locking members extend generally downwardly from said top and are displaced radially inwardly with respect to said skirt, said web portion serving to space said skirt outwardly with respect to the peripheral edge region of said top.

8. The combination of claim 1 wherein said top of said closure has a convex dish-shaped configuration which extends upwardly in the direction from the peripheral edge region of the top to a central region thereof when the locking means are in the locking position.

9. The combination of claim 8 wherein said skirt is integrally connected to said top at a junction having a reduced thickness relative to the thickness of the skirt and top, and wherein a hinge groove is formed in a lower surface of said top extending around a central portion thereof, such that when a pressure is applied on said top which is in excess of a certain minimum required pressure, said top will snap into a concave configuration, said top flexing about said reduced thickness junction which acts as a hinge and said hinge groove, whereupon said locking means move to the non-locking position.

10. The combination of claim 9 wherein the snapping of said top creates an audible noise indicative of the movement of said locking means from the locking to the non-locking position.

11. The combination of claim 1 wherein said locking means is constituted by at least one locking member extending downwardly from the undersurface of a dish-shaped portion of said top and spaced inwardly from said skirt so as to be adapted to be situated within the neck of a bottle or container with which the closure is associated.

12. The combination of claim 11 wherein each of said locking members terminates at its lower end with an outwardly extending catch portion.

13. The combination of claim 1 wherein said skirt includes a lower circumferentially extending portion and an upper circumferentially extending portion, said upper skirt portion being formed by a plurality of locking segments, each of said locking segments being integrally joined with said top and with said lower skirt portion and separated from each other at adjoining side surfaces, and wherein said locking means comprise said locking segments and locking members formed on said locking segments.

14. The combination of claim 13 wherein each of said locking segments is integrally joined with said top at an upper groove hinge and is integrally joined with said lower skirt portion at a lower groove hinge 15. The combination of claim 13 wherein said locking members comprise tooth structure formed integrally with and extending inwardly from said locking segments.

16. The combination of claim 15 wherein each tooth of said tooth structure is defined by an angled leading edge and a substantially radial trailing edge.

17. The combination of claim 13 wherein said locking members comprise locking fingers extending inwardly from said locking segments.

18. The combination of claim 13 wherein said top of said closure has a dish-shaped configuration when said locking means are in the locking position and a substantially planar configuration when the locking means are in the non-locking position.

19. The combination of claim 18 wherein said top of said closure has a convex dish-shaped configuration which extends upwardly in the direction from the peripheral edge region of the top to the central region thereof when the locking means are in the locking position.

20. The combination of claim 18 wherein said top of said closure has a concave dish-shaped configuration which extends downwardly in the direction from the peripheral edge region of the top to the central region thereof when the locking means are in the locking position.

21. The combination of claim 20 wherein a handle is provided on the central region of said closure top.

22. The combination of claim 1 wherein said minimum required pressure to deform said top from its locking configuration to its non-locking configuration is at least about 8 pounds.

23. The combination of claim 22 wherein said minimum required pressure to deform said top from its locking configuration to its non-locking configuration is in the range of about 10 to 12 pounds.

24. A safety closure and container combination, comprising:

a safety closure, including a closed top having a peripheral edge region;

an interiorly threaded skirt integral with and depending from the peripheral edge region of said cap, said skirt adapted to threadedly mate with an externally threaded neck of said container means;

locking means formed integrally with said closure and movable under the action of actuating means from a locking position in which the locking means are in engaging relationship with at least one locking element provided on the neck of said container means to a non-locking position in which the locking means are in non-engaging relationship with said at least one locking element; and actuating means for moving said locking means from the locking position to the non-locking position, said actuating means being constituted by said top of said closure which has a substantially dish-shaped locking configuration such that the application of a finger pressure on said top in excess of a certain minimum required pressure will deform said top into a non-locking configuration and result in movement of said locking means from the locking to the non-locking position; and container means, including an exteriorly threaded neck; and at least one locking element provided on said neck adapted to engage said locking means when the closure is tightened on said neck with said locking means in the locking position and wherein rotation of said closure in an untightening direction is attempted.

25. The combination of claim 24 wherein said at least one locking element is formed on the outer surface of said neck of said container means.

26. The combination of claim 25 wherein said locking means are constituted by at least one tab-like locking member, each of which is integrally joined to the peripheral edge region of said top, and wherein said at least one locking element is constituted by a protuberance formed on the exterior surface of said neck of said container means, said protuberance presenting a substantially radial surface facing in the tightening direction of said closure and adapted to engage said locking member when the latter is in its locking position and the closure is rotated in the untightening direction.

27. The combination of claim 26 wherein said protuberance further includes an angled surface facing in the untightening direction of rotation of said closure.

28. The combination of claim 24 wherein said combination further includes means for automatically moving said locking means from the non-locking position to the locking position only after the initiation of the rotation of said safety closure in an untightening direction from said neck of said container means.

29. The combination of claim 28 wherein said automatic means is constituted by said closure top which is configured such that after the same is deformed from its locking configuration to its non-locking configuration, it will remain in its non-locking position, and means for urging said closure top back to its locking configuration after the initiation of the rotation of said safety closure in an untightening direction from said neck of said container means.

30. The combination of claim 29 wherein said urging means include a finger extending downwardly from the undersurface of said top of said closure such that it extends within said neck when said closure is mounted thereon, and a protuberance formed on the inner surface of said neck extending radially inwardly for a limited distance, and wherein said finger extends from the undersurface of said top such that when said top is in its locking configuration said finger is spaced a sufficient distance from the inner surface of the neck that it will not engage said protuberance as said closure is rotated in a tightening direction onto the neck, and such that when said top is in its non-locking configuration said finger is closer to the inner surface of the neck and will engage said protuberance as said closure is rotated in an intightening direction from said neck, whereby said top is flexed towards its locking configuration.

31. The combination of claim 28 wherein said automatic means is constituted by said closure top which is configured such that after the same is deformed from its locking configuration to its non-locking configuration, it will spring back to its locking configuration unless otherwise restrained, and means for restraining said closure top in its non-locking configuration until after the initiation of the rotation of said safety closure in an untightening direction from said neck of said container means.

32. The combination of claim 31 wherein said neck of said container means has an upper edge surface and said safety closure includes bead means adapted to sealingly engage said upper edge surface of said neck when said closure is tightened on said neck, and wherein said restraining means comprise a bevelled outer region of said upper edge surface of said neck and an inwardly facing planar surface formed on said bead means, whereby when said top is tightened on said neck and deformed to its non-locking configuration, said inwardly facing planar surface engages said bevelled outer region to frictionally restrain said top from returning to its locking configuration and as said closure is rotated in an untightening direction said planar surface will become disengaged from said bevelled outer region whereupon all restraints tending to hold the top in its non-locking configuration are removed so that said top will spring back to its locking configuration.

33. The combination of claim 24 wherein said at least one locking element is formed on the inner surface of said neck of said container means.

34. The combination of claim 33 wherein said safety closure locking means are constituted by at least one locking member extending downwardly from the under surface of a dish-shaped portion of said top and spaced inwardly from said skirt so as to be situtated within said neck of said container means as said closure is tightened thereon, and wherein said locking element is provided on the inner surface of said neck, said locking member and element being formed such that when said top is in its locking configuration and the closure is tightened on said neck, said locking member engages said locking element to prevent rotation of said closure in an untightening direction and when said top is deformed to its non-locking configuration, said locking member is disengaged from said locking element thereby permitting rotation of said closure in the untightening direction.

35. The combination of claim 34 wherein each of said locking members terminates at its lower end with an outwardly extending catch portion having a curved leading surface in the tightening direction and wherein each of said locking elements comprise a substantially L-shaped locking element.

36. The combination of claim 24 wherein said skirt includes a lower circumferentially extending portion and an upper circumferentailly extending portion, said upper skirt portion being formed by a plurality of locking segments, each of said locking segments being integrally joined with said top and with said lower skirt portion and separated from each other at adjoining side surfaces, and wherein said locking means comprise said locking segments and tooth structure formed on said locking segments and wherein said locking element comprises an outwardly extending toothed rim formed on said neck of said container means.

* * * * *